US006575252B2

(12) United States Patent
Reed

(10) Patent No.: US 6,575,252 B2
(45) Date of Patent: Jun. 10, 2003

(54) SPRINKLER HEAD DEACTIVATING TOOL

(76) Inventor: Jeffrey Paul Reed, 7570 Love Rd., Hamersville, OH (US) 45130

( * ) Notice: Subject to any disclaimer, the term of this patent is extended or adjusted under 35 U.S.C. 154(b) by 21 days.

(21) Appl. No.: 09/867,300

(22) Filed: May 29, 2001

(65) Prior Publication Data

US 2002/0179746 A1 Dec. 5, 2002

(51) Int. Cl.[7] ..... A62C 39/00

(52) U.S. Cl. ..... 169/90; 239/569; 251/90; 81/44

(58) Field of Search ..... 169/90; 251/83, 251/90, 291, 321; 81/44, 150, 151; 239/569

(56) References Cited

U.S. PATENT DOCUMENTS

| | | | | | |
|---|---|---|---|---|---|
| 372,503 | A | * | 11/1887 | Wheeler | 16/DIG. 21 |
| 851,487 | A | * | 4/1907 | Bergmann | 251/321 |
| 858,832 | A | * | 7/1907 | Short | 169/90 |
| 917,923 | A | * | 4/1909 | Casey | 169/90 |
| 1,325,507 | A | * | 12/1919 | Casey | 169/90 |
| 2,095,696 | A | * | 10/1937 | Hackel | 184/1.5 |
| 2,700,423 | A | * | 1/1955 | Burkert | 138/89 |
| 2,743,782 | A | * | 5/1956 | Occhipinti | 169/39 |
| 3,191,685 | A | * | 6/1965 | Warne | 138/89 |
| 3,550,687 | A | * | 12/1970 | Thaxton | 169/37 |
| 3,587,979 | A | * | 6/1971 | Butts | 169/37 |
| 3,976,141 | A | | 8/1976 | Harrington | |
| 4,191,257 | A | * | 3/1980 | Mohler | 169/90 |
| 4,366,866 | A | | 1/1983 | Sweeney | |
| 4,804,046 | A | | 2/1989 | Capasso | |
| 4,923,013 | A | | 5/1990 | De Gennaro | |
| 5,018,770 | A | | 5/1991 | Beasley | |
| D347,681 | S | | 6/1994 | Scardaoni | |
| 5,560,430 | A | * | 10/1996 | Enos | 169/90 |
| 5,732,778 | A | | 3/1998 | Tateno | |
| 5,799,550 | A | * | 9/1998 | Hsieh | 81/129 |
| 6,044,912 | A | | 4/2000 | Tsuji et al. | |
| 6,073,700 | A | | 6/2000 | Tsuji et al. | |
| 6,112,821 | A | | 9/2000 | Yokoi | |

* cited by examiner

*Primary Examiner*—Michael Mar
*Assistant Examiner*—Darren Gorman
(74) *Attorney, Agent, or Firm*—Bose McKinney & Evans LLP

(57) ABSTRACT

A tool for deactivating a sprinkler head. The tool includes a housing, a first arm supported by the housing and a second arm supported for movement relative to the first arm. A first engagement surface is supported by the first arm and a second engagement surface is supported by the second arm. The first and second engagement surfaces are adapted for positioning intermediate a valve and a receiving support of the sprinkler head. A biasing member is operably connected to the second arm for urging the second engagement surface away from the first engagement surface. A handle is supported by the second arm and is moveable relative to the housing.

14 Claims, 6 Drawing Sheets

SPRINKLER HEAD DEACTIVATING TOOL

BACKGROUND OF THE INVENTION

1. Field of the Invention

The present invention relates to a tool for deactivating sprinkler heads and, more particularly, to a hand tool for sealing valves within sprinkler heads to stop the flow of water therefrom.

2. Description of the Prior Art

Automatic fire suppression systems, particularly fire sprinkler systems, have found wide spread use throughout a variety of buildings and other structures given their effectiveness in reducing property damage, injury, and loss of life from fires. Conventional automatic sprinkler systems typically include a plurality of sprinkler heads connected to a source of water. When a sprinkler head detects a fire, a valve is released thereby permitting the flow of water therethrough. It is not uncommon for a single sprinkler head to supply water at a rate of approximately 100 gallons per minute.

As may be readily appreciated, once activated, the sprinkler head will quickly deluge the surrounding area with water such that items kept in the vicinity of the sprinkler head may quickly suffer from water damage. Additionally, malfunctions of sprinkler heads may be caused by the head suffering impact or due to greatly varying ambient temperatures. Both of these conditions may cause inadvertent activation of the sprinkler head.

Upon activation of the sprinkler heads, firefighters will typically be the first to respond and deactivate the sprinkler heads. Conventionally, the release of water from the sprinkler heads is prevented by deactivating the sprinkler system as a whole at a main water flow control valve. The deactivation of a single sprinkler head is often attempted by inserting or jamming a wood wedge into the head in order to seal the flow of water therefrom. Unfortunately, such prior art attempts to deactivate single sprinkler heads is capable, at best, of arresting only a portion of the flow of water. As a result, a substantial amount of water damage typically occurs before the system as a whole may be deactivated. Additionally, recessed head sprinklers provide an additional difficulty in inserting wedges to prevent the flow of water.

Therefore, there remains a need for a tool capable of quickly, effectively, and reliably deactivating a sprinkler head by stopping of the flow of water therethrough.

SUMMARY OF THE INVENTION

The present invention provides a hand tool for deactivating a sprinkler head to stop the flow of water therefrom. The sprinkler head may be of conventional design as including a spacer positioned intermediate a valve and a receiving support, the valve supported by the spacer in releasable sealing engagement with a valve seat.

The tool of the present invention includes a housing having a side wall with at least one elongated slot and defining an interior chamber. The housing further includes a proximal end, an opposing distal end, and a longitudinal axis extending between the proximal and distal ends.

A first arm extends outwardly from the distal end of the housing and includes a first support portion extending substantially parallel to the longitudinal axis. A first jaw portion extends substantially perpendicularly to the first support portion and supports a first engagement surface.

A second arm is slidably received within the interior chamber of the housing and is supported for movement relative to the first arm. The second arm includes a second support portion which extends substantially parallel to the first support portion. A second jaw portion extends substantially perpendicularly to the second support portion and supports a second engagement surface. The first and second engagement surfaces are adapted for positioning intermediate the valve and the receiving support of the sprinkler head.

A compression spring is operably connected to the second arm for urging the second engagement surface away from the first engagement surface. At least one handle is supported by the second arm and is moveable relative to the housing within the at least one elongated slot. A protective sleeve is slidably supported by the housing and substantially covers the at least one elongated slot. The compression spring is supported within the housing intermediate a pin and the at least one handle. A resilient base is supported by the proximal end of the housing and is adapted to be received within the palm of the user.

In operation, the user positions the resilient base of the tool within the palm of his or her hand and then slidably moves the second jaw downwardly toward the first jaw by pressing down on the at least one handle. This action brings the first and second engagement surfaces towards each other. Next, the user places the first and second jaws intermediate the valve and the receiving support of the sprinkler head. The user then releases the handle such that the compression spring drives the second jaw portion away from the first jaw portion. In response, the second engagement surface and first engagement surface are spread apart, thereby causing the valve of the sprinkler head to move upwardly and into engagement with the valve seat for stopping the flow of water from the sprinkler head.

Therefore, it is an object of the present invention to provide a tool for quickly, effectively, and reliably deactivating a sprinkler head by stopping the flow of water therethrough.

It is a further object of the present invention to provide a sprinkler head deactivating tool which minimizes the damage resulting from the undesired and continuous flow of water from the sprinkler head.

It is a another object of the present invention to provide such a tool which is capable of being easily carried and stored by the user.

It is a further object of the present invention to provide a tool for deactivating a sprinkler head and including a pair of separable engagement surfaces for placing the valve of a sprinkler head against its valve seat.

Other objects and advantages of the invention will be apparent from the following description, the accompanying drawings, and the appended claims.

DETAILED DESCRIPTION OF THE PREFERRED EMBODIMENT

Figure 1:
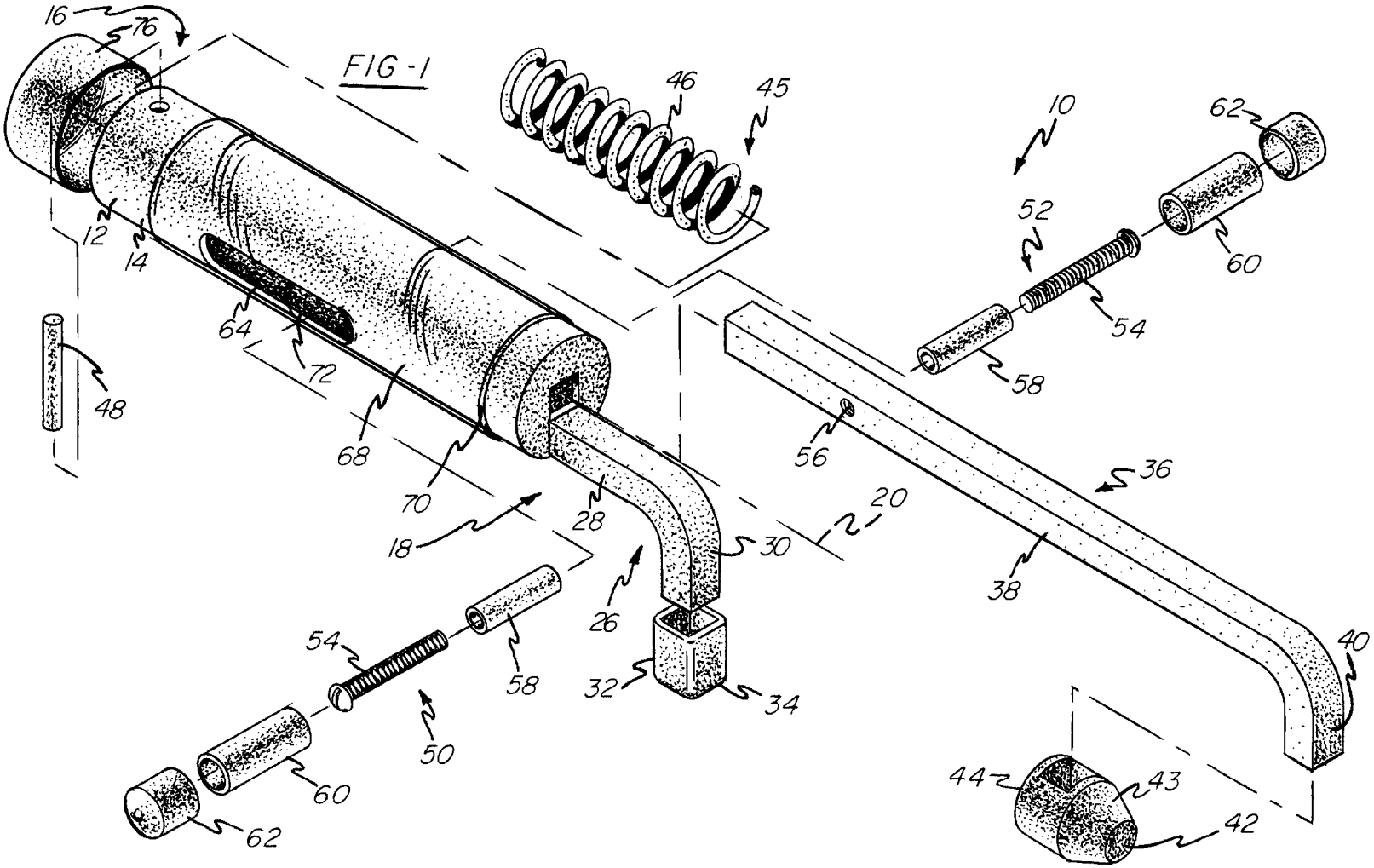
FIG. 1 is a partially exploded perspective view of the tool of the present invention.
Figure 2:
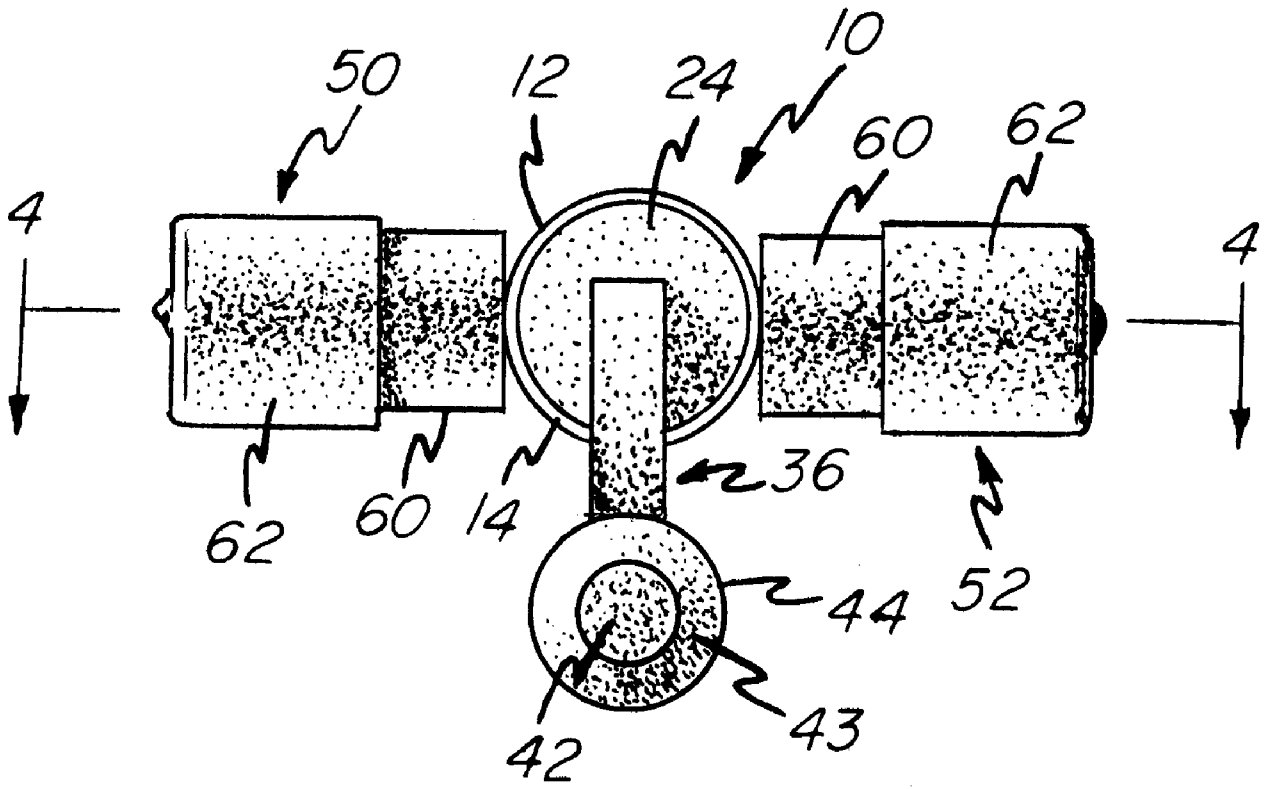
FIG. 2 is a top plan view of the tool of the present invention.
Figure 3:
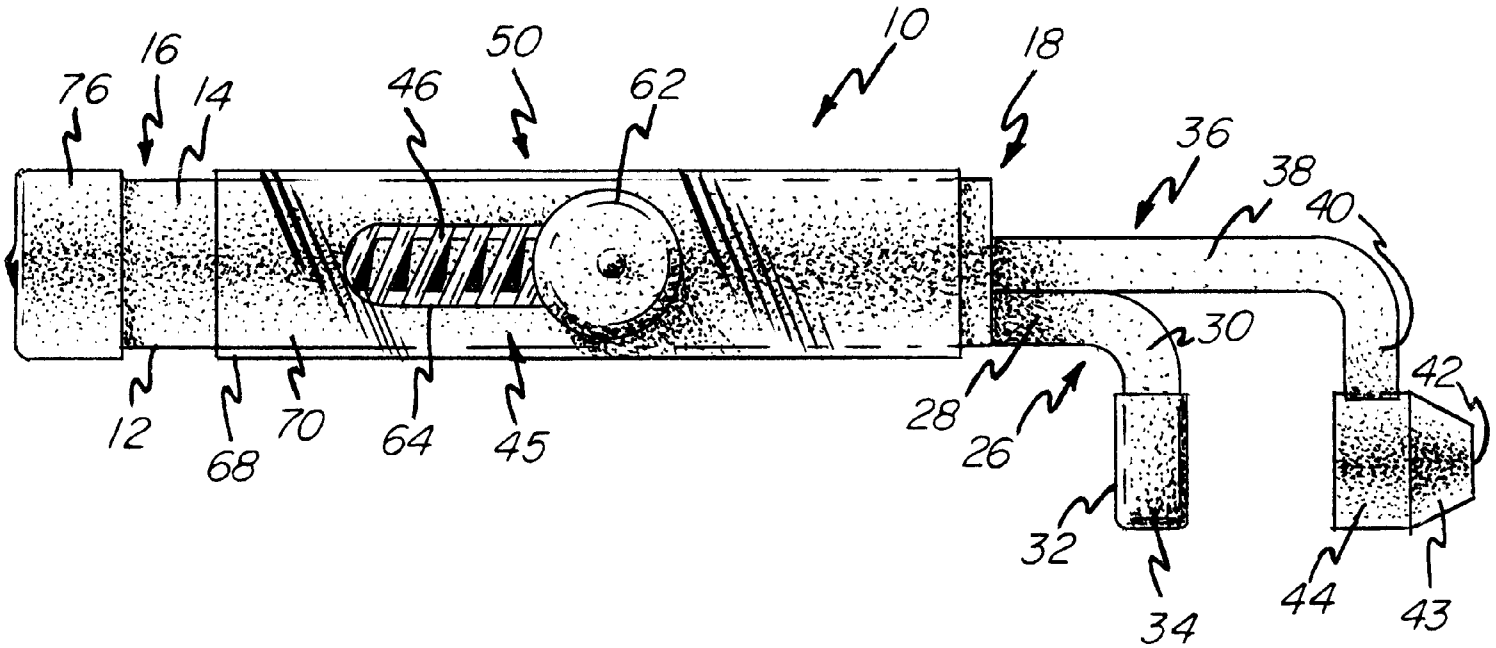
FIG. 3 is a side elevational view of the tool of FIG. 2.
Figure 4:
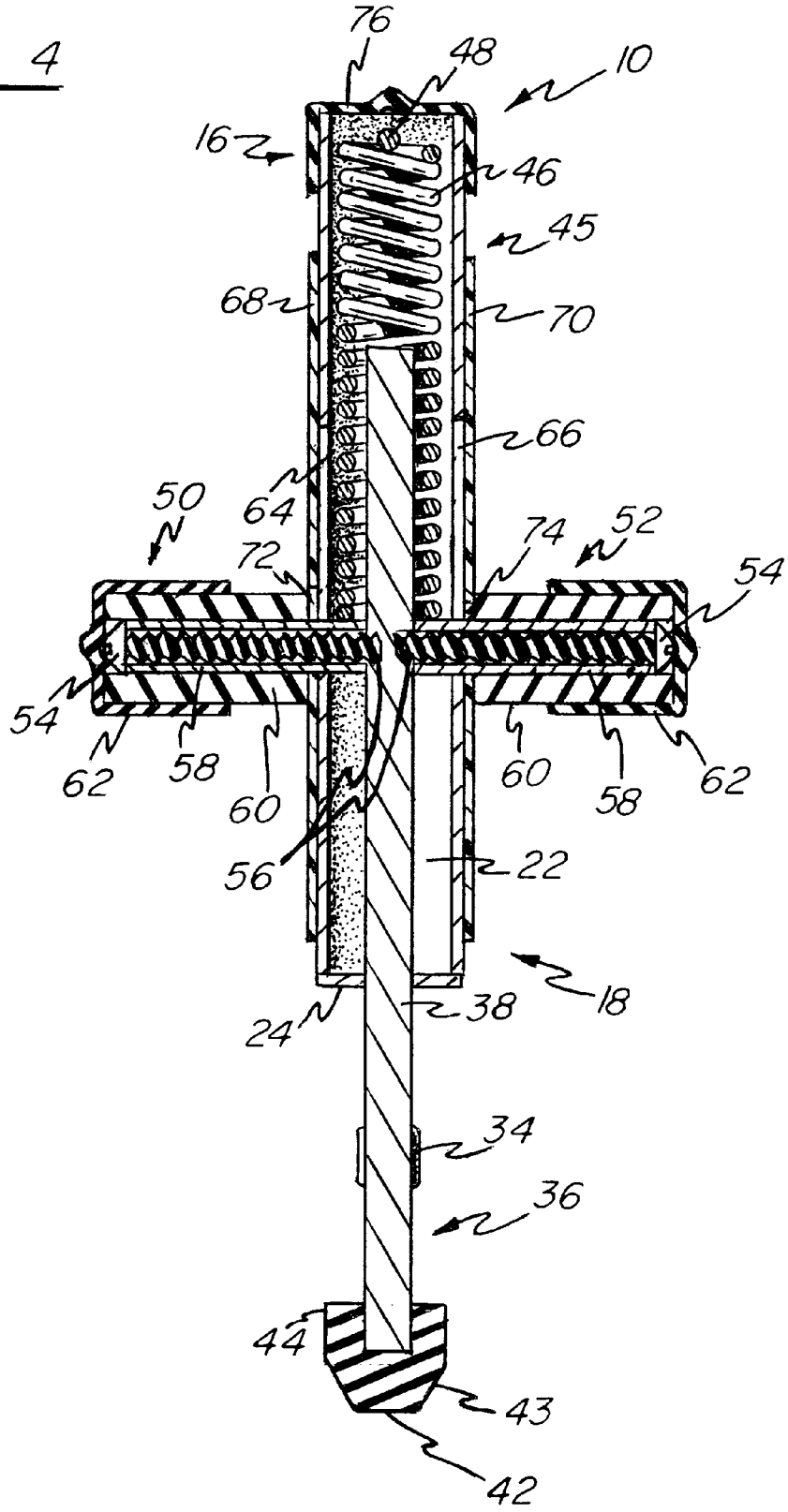
FIG. 4 is a cross-sectional view of the tool of the present invention taken along lines 4—4 of FIG. 2.

Referring initially to FIGS. 1–4, the sprinkler head deactivating tool 10 of the present invention includes a housing 12 having a cylindrical side wall 14. The side wall 14 defines opposing proximal and distal ends 16 and 18 and a longitudinal axis 20. An interior chamber 22 is defined within the housing 12 and extends between the proximal and distal ends 16 and 18 (FIG. 2). The proximal end 16 of the housing 12 is preferably open while the distal end 18 of the housing 12 preferably includes an end wall 24 secured thereto. The housing 12 is preferably composed of a strong, durable material such as hardened steel.

A first arm 26 is fixed to the housing 12 adjacent the distal end 18. More particularly, the first arm 26 includes a first support portion 28 secured the end wall 24 and extending outwardly therefrom in substantially parallel relation to the longitudinal axis 20. A first jaw portion 30 is connected to the first support portion 28 and extends substantially perpendicularly thereto. A first engagement surface 32 is supported by the first jaw portion 30. A first resilient member 34 may be secured to the first jaw portion 30. The first resilient member 34 may comprise an elastomeric sleeve fixed to the first jaw portion 30 through a conventional adhesive.

A second arm 36 is supported for movement relative to the first arm 26. The second arm 36 includes a second support portion 38 extending substantially parallel to the first support portion 28 and to the longitudinal axis 20. The second support portion 38 is slidably received within the interior chamber 22 of the housing 12 for movement in a direction substantially parallel to the longitudinal axis 20. A second jaw portion 40 is connected to the second support portion 38 and extends in a direction substantially perpendicular thereto. A second engagement surface 42 is supported by the second jaw portion 40 and, as such, is supported for movement relative to the first engagement surface 32. A second resilient member 44 is preferably supported by the second jaw portion 40 and may comprises an elastomeric sleeve fixed to the second arm 36 through a conventional adhesive. The elastomeric sleeve may include a protuberance or spacer 43 in order to accurately provide the necessary separation between the first and second engagement surfaces 32 and 42.

Both the first and second arms 26 and 36 are preferably formed of a strong, durable material such as hardened steel.

The first engagement surface 32 faces in a proximal direction away from the first jaw portion 30. The second engagement surface 42 faces in a distal direction away from the first jaw portion 30 and first engagement surface 32. As may be readily appreciated, separation of the second arm 36 away from the first arm 26 causes similar separation between the first engagement surface 32 and second engagement surface 42.

A locking device, preferably in the form of a biasing member 45 is operably connected to the second arm 36 for urging the second engagement surface 42 away from the first engagement surface 32. The biasing member 45 preferably includes a compression spring 46 slidably receiving the second support portion 38 of the second arm 36. A pin 48 is preferably fixed to the side wall 14 of the housing 12 and extends within the interior chamber 22 adjacent the proximal end 16. The spring 46 is received intermediate the pin 48 and a pair of handles 50 and 52 which are supported by the second arm 36.

Each handle 50 and 52 is secured to the second support portion 38 of the second arm 36 through a conventional fastener, such as a screw 54 threadably received within a threaded aperture 56 formed within the second support portion 38. A sleeve 58, preferably formed of metal, is positioned around each screw 54, while a second sleeve 60 is preferably concentrically received around each first sleeve 58. The second sleeve 60 is preferably composed of a resilient material for cushioning the fingers of a user Finally, an end cap 62 is received over each second sleeve 60.

The handles 50 and 52 extend through a pair of opposing elongated slots 64 and 66 formed within the side wall 14 of the housing 12. The elongated slots 64 and 66 permit for the movement of the handles 50 and 52 and, in turn, the second arm 36 in a longitudinal direction. A protective sleeve 68 slidably receives the housing 12. The protective sleeve 68 includes a cylindrical side wall 70 concentrically disposed with the side wall 14 of the housing 12. The first sleeves 58 of the handles 50 and 52 pass through opposing apertures 72 and 74 formed within the protective sleeve 68. In a preferred embodiment, the protective sleeve 68 is preferably formed of a clear thermoplastic material, although similar materials may be readily substituted therefore. As may be appreciated, the protective sleeve 68 protects the user from pinching his or her fingers within the elongated slots 64 and 66 of the housing 12 as the handles 50 and 52 are moved.

Movement of the handles 50 and 52 toward the proximal end 16 of the housing 12 results in compression of the spring 46 between the respective first sleeves 58 and the pin 48. As such, the second jaw portion 40 of the second arm 36 is biased by the spring 46 in a distal direction away from the first jaw portion 30 of the first arm 26. Movement in the distal direction is stopped when the handles 50 and 52 reach the end of the slots 64 and 66 closest to the distal end 18 of the housing 12.

A resilient base 76, preferably in the form of an end cap, is secured to the proximal end 16 of the housing 12 for cushioning the palm of a user. The resilient base 76 may be composed of an elastomeric material, although similar materials may be readily substituted therefor.

Figure 5:
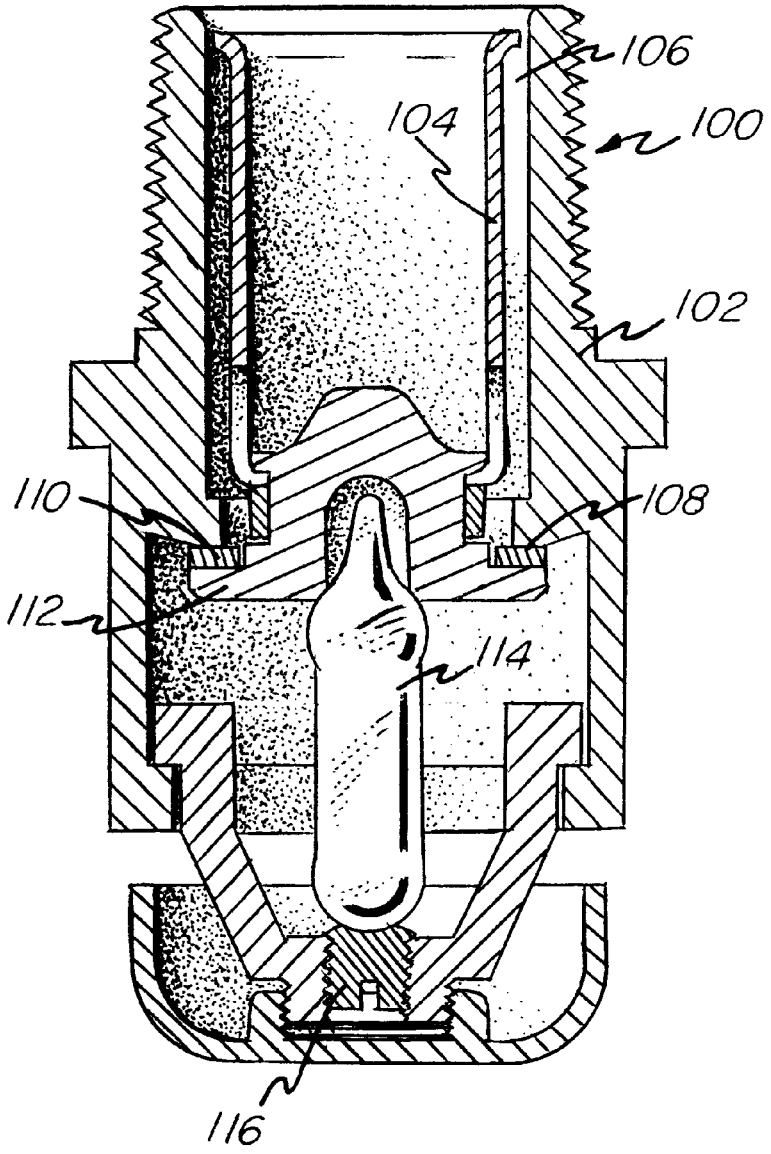
FIG-5 PRIOR ART
FIG. 5 is a cross-sectional view of a conventional sprinkler head in an inactive mode and including a spacer positioned intermediate a valve and a receiving support.
Figure 6:
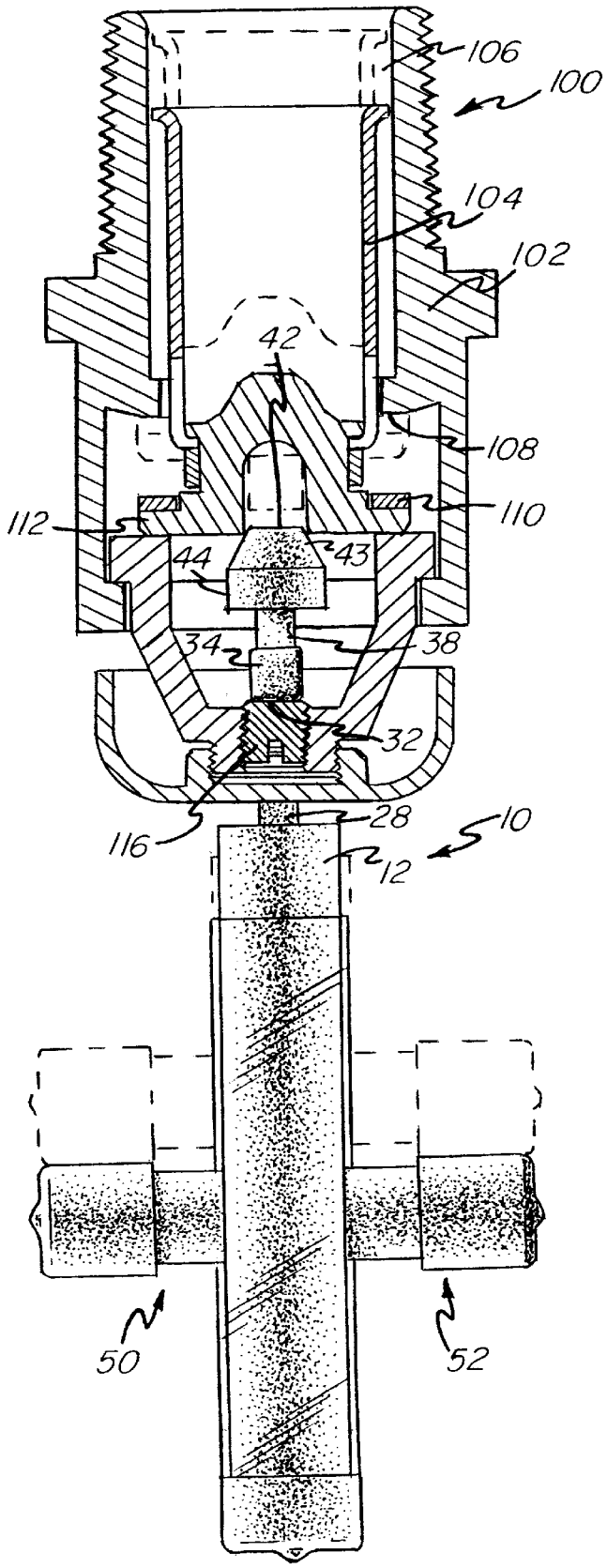
FIG. 6 is a cross-sectional view of the sprinkler head of FIG. 5 in an active mode and illustrating the tool of the present invention in an operative position.

Turning now to FIGS. 5 and 6, the operation of the sprinkler head deactivating tool 10 of the present invention will be described in greater detail. As detailed above, the tool 10 is utilized to prevent the flow of water through a conventional sprinkler head 100. The sprinkler head 100 typically includes a body 102 connected to a source of water through conventional piping (not shown). A nozzle 104 is supported within a fluid passage 106 formed within the body 102. The body 102 preferably defines a valve seat 108 for sealably engaging an annular seal 110 supported by a moveable valve 112. In an inactive mode of the sprinkler head 100, the valve 112 is positioned in sealing engagement with the valve seat 108 by a spacer, preferably a glass bulb 114 positioned intermediate the valve 112 and a receiving support 116. The receiving support 116 typically comprises a conventional pressure screw.

The glass bulb 114 preferably contains a thermally expanding fluid which is pressurized upon heating for shattering the glass bulb 114. When the glass bulb 114 shatters, or is otherwise dislodged from its position in FIG. 5, then the valve 112 moves downwardly along with the nozzle 104. In this active mode of the sprinkler head 100, thereby allowing for the flow of water is permitted since the seal 110 of the valve 112 is no longer sealingly engaging the valve seat 108.

To deactivate the sprinkler head 100 as illustrated in FIG. 6, a user of the tool 10 places the resilient base 76 within the palm of his or her hand and then pulls downwardly on the pair of handles 50 and 52 thereby moving the second arm 36 downwardly relative to the first arm 26. As such, the first and second engagement surfaces 32 and 42 move towards each other. The first and second jaw portions 30 and 40 are then placed intermediate the valve 112 and the support 116.

Next, the user releases the handles 50 and 52 to return the tool 10 into an operative position as illustrated in phantom in FIG. 6. The second arm 36 moves upwardly away from the first arm 26 due to action of the spring 46. The first engagement surface 32 bears against the support 116 while the second engagement surface 42 moves upwardly into engagement with the valve 112 for forcing the valve 112 and the nozzle 104 upwardly toward the fluid passage 106. The seal 110 of the valve 112 then once again sealingly engages the valve seat 108, thereby stopping the flow of water through the sprinkler head 100.

Once the system to which the sprinkler head 100 is connected is deactivated, the tool 10 may be removed. The sprinkler head 100 may then be reset by replacing the glass bulb 114 in a conventional manner.

As may be appreciated from the foregoing, the sprinkler head deactivating tool 10 of the present invention provides for the simple, efficient, and convenient deactivation of individual sprinkler heads 100.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A tool for deactivating a sprinkler head to stop the flow of water therefrom, the sprinkler head including a spacer positioned intermediate a valve and a receiving support, the valve supported by the spacer in releasable sealing engagement with a valve seat, said tool comprising:

a housing including a proximal end, an opposing distal end, and a longitudinal axis extending between said proximal end and said distal end;

a first arm extending outwardly from said distal end of said housing;

a second arm supported for movement relative to said first arm;

a first engagement surface supported by said first arm;

a second engagement surface supported by said second arm;

said first engagement surface and said second engagement surface adapted for positioning intermediate the valve and the receiving support of the sprinkler head;

a biasing member operably connected to said second arm for urging said second engagement surface away from said first engagement surface; and at least one handle supported by said second arm and moveable relative to said housing.

2. The tool of claim 1 wherein:

said first arm comprises a first support portion extending substantially parallel to said longitudinal axis and a first jaw portion extending substantially perpendicular to said first support portion, said first engagement surface supported by said first jaw portion; and said second arm comprises a second support portion extending substantially parallel to said first support portion and a second jaw portion extending substantially perpendicular to said second support portion, said second engagement surface supported by said second jaw portion.

3. The tool of claim 2 further comprising first and second resilient members supported by said first and second jaw portions, said first and second resilient members defining said first and second engagement surfaces.

4. The tool of claim 2 wherein:

said housing includes a side wall defining an interior chamber; and said second support portion of said second arm is slidably supported within said interior chamber.

5. The tool of claim 4 wherein said housing includes at least one elongated slot formed within said side wall for receiving said at least one handle.

6. The tool of claim 5 further comprising a protective sleeve slidably receiving said housing and substantially covering said at least one elongated slot.

7. The tool of claim 4 wherein said biasing member comprises a compression spring receiving said second arm.

8. The tool of claim 7 further comprising a pin fixed within said housing adjacent said proximal end, wherein said spring is received intermediate said at least one handle and said pin.

9. The tool of claim 1 further comprising a resilient base supported by said proximal end of said housing and adapted to be received within the palm of a user.

10. A tool for deactivating a sprinkler head to stop the flow of water therefrom, the sprinkler head including a spacer positioned intermediate a valve and a receiving support, the valve supported by the spacer in releasable sealing engagement with a valve seat, said tool comprising:

a housing including a side wall defining an interior chamber, said housing further including a proximal end, an opposing distal end, and a longitudinal axis extending between said proximal end and said distal end;

a first arm extending outwardly from said distal end of said housing, said first arm including a first support portion extending substantially parallel to said longitudinal axis, a first jaw portion extending substantially perpendicular to said support portion, and a first engagement surface supported by said first jaw portion;

a second arm supported for movement relative to said first arm, said second arm comprising a second support portion slidably supported within said interior chamber of said housing and extending substantially parallel to said first support portion, a second jaw portion extending substantially perpendicular to said second support portion, and a second engagement surface supported by said second jaw portion;

said first engagement surface and said second engagement surface being adapted for positioning intermediate the valve and the receiving support of the sprinkler head; and a compression spring receiving said second support portion of said second arm, said compression spring being configured to separate said first and second jaw portions into a fixed operative position wherein said first and second engagement surfaces support the valve of the sprinkler head in sealing engagement with the valve seat and in spaced relation with the receiving support.

11. The tool of claim 10 further comprising first and second resilient members supported by said first and second jaw portions, said first and second resilient members defining said first and second engagement surfaces.

12. A tool for deactivating a sprinkler head to stop the flow of water therefrom, the sprinkler head including a spacer positioned intermediate a valve and a receiving support, the valve supported by the spacer in releasable sealing engagement with a valve seat, said tool comprising:

a housing including a side wall defining an interior chamber, said housing further including a proximal end, an opposing distal end, and a longitudinal axis extending between said proximal end and said distal end;

a first arm extending outwardly from said distal end of said housing, said first arm including a first support portion extending substantially parallel to said longitudinal axis, a first jaw portion extending substantially perpendicular to said support portion, and a first engagement surface supported by said first jaw portion;

a second arm supported for movement relative to said first arm, said second arm comprising a second support portion slidably supported within said interior chamber of said housing and extending substantially parallel to said first support portion, a second jaw portion extending substantially perpendicular to said second support portion, and a second engagement surface supported by said second jaw portion;

said first engagement surface and said second engagement surface being adapted for positioning intermediate the valve and the receiving support of the sprinkler head; and at least one handle supported by said second support portion of said second arm and moveable relative to said housing, wherein said housing includes at least one elongated slot for receiving said at least one handle.

13. The tool of claim 12 further comprising a protective sleeve slidably receiving said housing and substantially covering said at least one elongated slot.

14. A tool for deactivating a sprinkler head to stop the flow of water therefrom, the sprinkler head including a spacer positioned intermediate a valve and a receiving support, the valve supported by the spacer in releasable sealing engagement with a valve seat, said tool comprising:

a housing including a side wall having at least one elongated slot and defining an interior chamber, said housing further including a proximal end, an opposing distal end, and a longitudinal axis extending between said proximal end and said distal end;

a first arm extending outwardly from said distal end of said housing, said first arm including a first support portion extending substantially parallel to said longitudinal axis, a first jaw portion extending substantially perpendicular to said support portion, and a first engagement surface supported by said first jaw portion;

a second arm supported for movement relative to said first arm, said second arm comprising a second support portion slidably received within said interior chamber of said housing and extending substantially parallel to said first support portion, a second jaw portion extending substantially perpendicular to said second support portion, and a second engagement surface supported by said second jaw portion;

said first engagement surface and said second engagement surface adapted for positioning intermediate the valve and the receiving support of the sprinkler head;

a compression spring operably connected to said second arm for urging said second engagement surface away from said first engagement surface;

at least one handle supported by said second arm and moveable relative to said housing within said at least one elongated slot; and a protective sleeve slidably receiving said housing and substantially covering said at least one elongated slot.

* * * * *